United States Patent [19]

Tsai

[11] Patent Number: 5,067,706

[45] Date of Patent: Nov. 26, 1991

[54] MULTIPLE-PURPOSE ASSEMBLED PLAYING SET

[76] Inventor: Wen-Guo Tsai, P.O. Box 55-1670, Taipei, Taiwan

[21] Appl. No.: 580,219

[22] Filed: Sep. 10, 1990

[51] Int. Cl.[5] ..... A63G 9/00

[52] U.S. Cl. ..... 272/85; 272/113; 272/89

[58] Field of Search ..... 272/85, 113, 89, 86–88

[56] References Cited

U.S. PATENT DOCUMENTS

| | | | |
|---|---|---|---|
| 1,956,502 | 4/1934 | Galatowitsch | 272/85 X |
| 2,146,045 | 2/1939 | Zippler | 272/89 |
| 2,616,485 | 11/1952 | Robbins | 272/85 X |
| 2,701,604 | 2/1955 | St. Louis | 272/85 |

*Primary Examiner*—Richard E. Chilcot, Jr.

[57] ABSTRACT

A multiple-purpose playing set includes a basic seat supported on a rope secured to a ceiling or a frame for serving as a swing, a longitudinal plate having a central portion engageable with the basic seat for serving as a seesaw, a basin having a central portion engageably mounted on the basic seat for serving as a cradle, and at least a bar tied on the rope for serving as a high bar or as a ladder. The longitudinal plate may also be inclinedly secured on the rope having an upper end portion of the rope fixed on an upper frame or a ceiling and having a lower end portion of the rope fixed on a bottom wall or a floor for serving as a slide.

8 Claims, 2 Drawing Sheets

MULTIPLE-PURPOSE ASSEMBLED PLAYING SET

BACKGROUND OF THE INVENTION

A conventional swing, seesaw, slide or high bar is always installed in an outdoor playground and always occupies a large volume or space, requiring a strong supporting frame or rod fixed on a floor. So, such a conventional playing apparatus is not suitable to be installed inside a house or narrow interior place. The outdoor playground is limited and can not be used in a rain day. The conventional playing equipments are generally made of ferrous materials which are easily rusted, dirty and heavy for difficult handling or installation.

SUMMARY OF THE INVENTION

The object of the present invention is to provide an assembled playing set which is interchangeable or replaceable with one another and may be assembled inside a house for selectively forming a swing, a seesaw, a cradle, a slide or a bar for multiple interesting uses.

DETAILED DESCRIPTION

Figure 4:
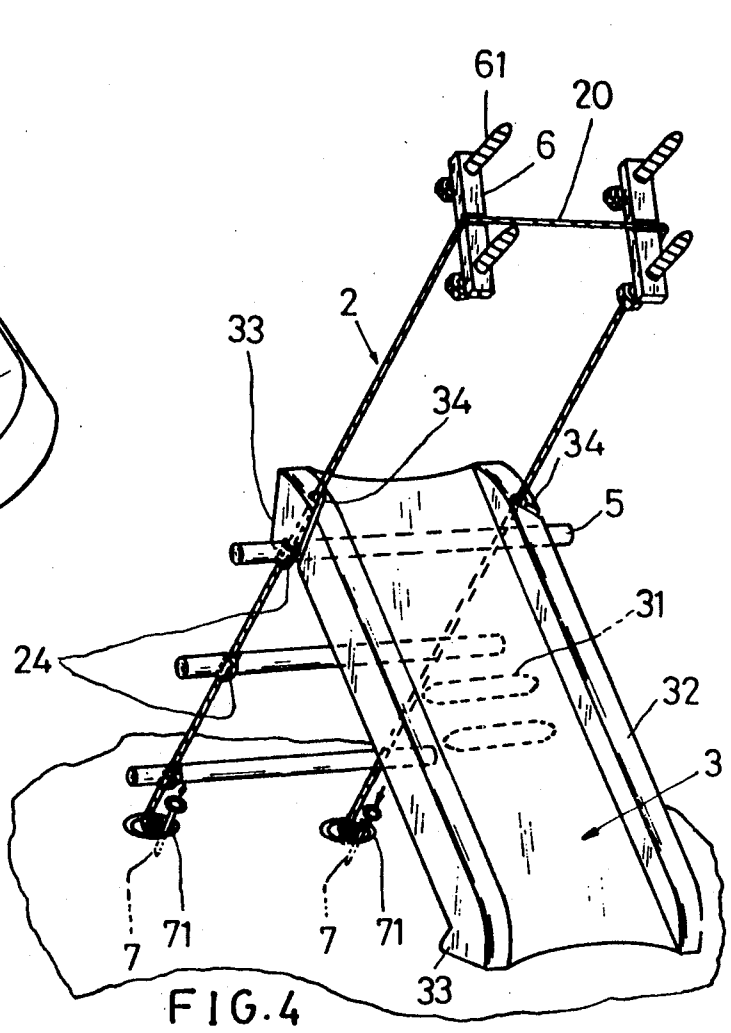
FIG. 4 is an illustration showing a slide made in accordance with the present invention.
Figure 1:
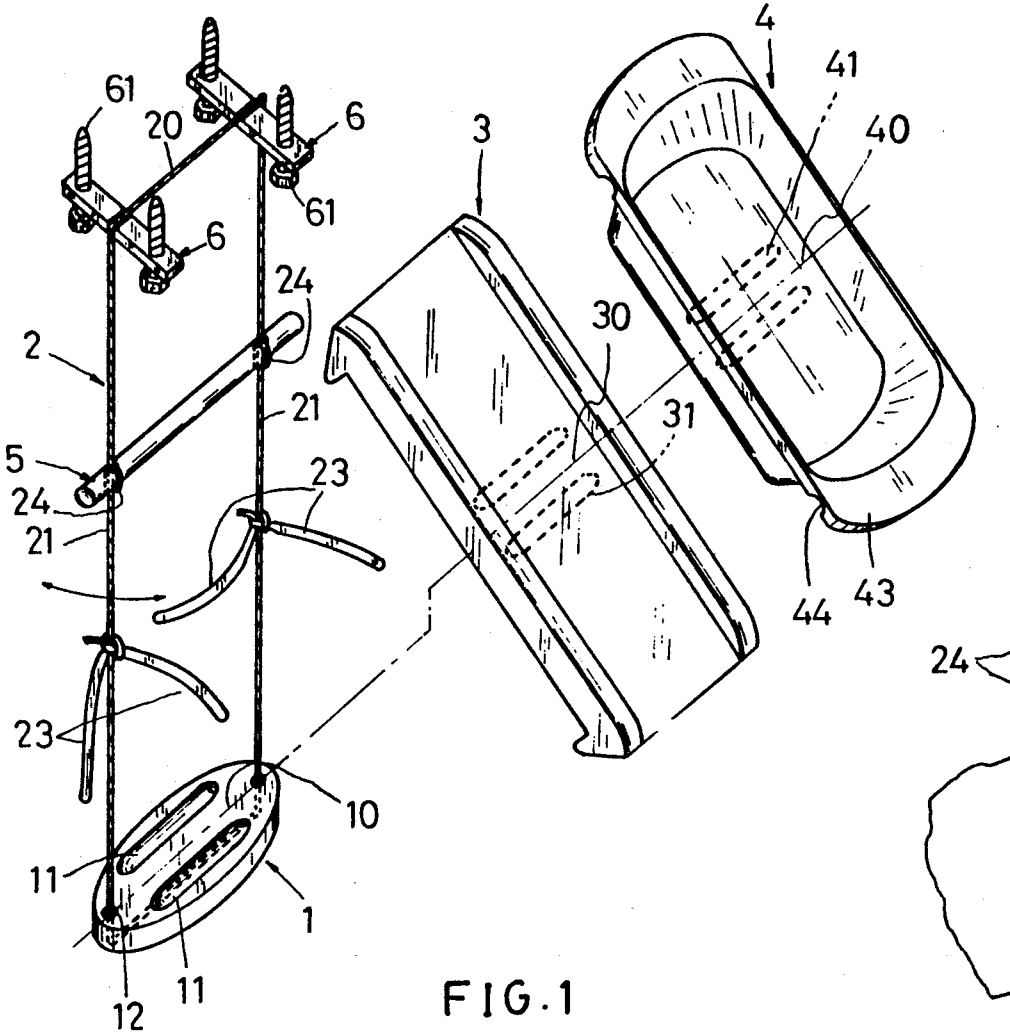
FIG. 1 is a perspective illustration showing all elements of the present invention.

As shown in FIGS. 1 and 4, the present invention comprises: a basic seat 1, a rope 2, a longitudinal plate 3, a basin 4, and at least a bar 5.

The basic seat 1 includes two elongate grooves 11 parallelly formed in the seat 1 disposed on a rear side and a front side of a central longitudinal axis 10 formed on the seat, and two rope holes 12 formed in a right side and a left side of the seat generally perpendicular to the longitudinal axis 10 of the seat 1.

Figure 2:
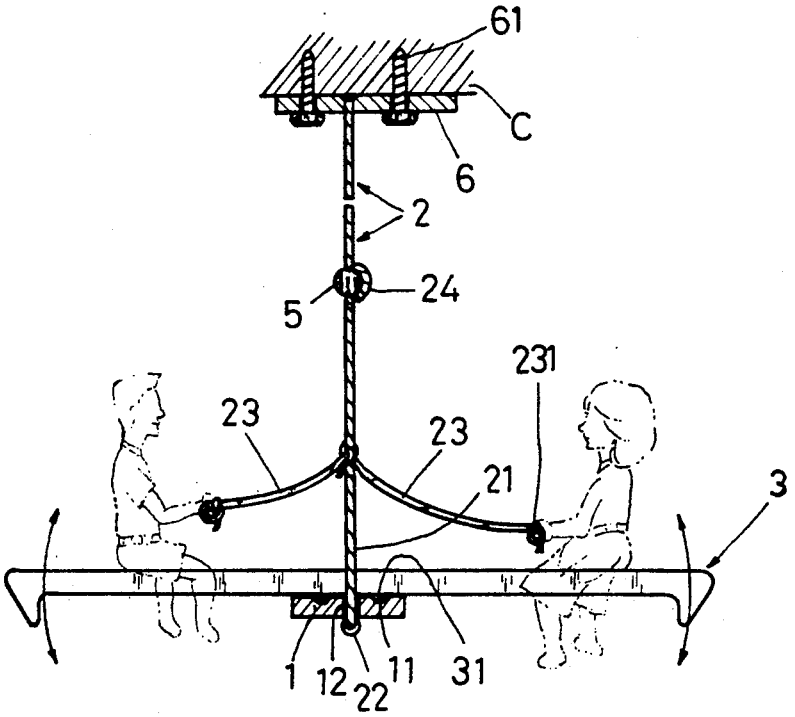
FIG. 2 shows a seesaw made in accordance with the present invention.

The rope 2 is generally formed as a U shape having two rope strings 21 protruding downwardly from two opposite side portions of a top loop portion 20 which is hanged on two upper brackets 6 secured to a ceiling C or an upper frame (not shown) by fixing elements 61 such as nails, screws or bolts. The two rope strings 21 respectively inserted through two rope holes each inserted through each rope hole 12 formed in the basic seat 1 and then tied together to form an unique knot 22 under the seat 1 the two strings 21 may also be respectively tied to form two knots 22 each knot 22 retained under each seat hole 12 for limiting the seat 1. Two pairs of straps 23 are respectively secured to the two rope strings 21 for player's holding purpose. The bar 5 can be tied on the rope 2 at numerals 24 as shown in FIGS. 1, 2, 4. For safety reason, the upper bracket 6 should be firmly secured on a ceiling or frame very firmly for safely protecting the players.

After mounting the basic seat 1 on a lower portion of each rope string 21, the seat 1 is then pendantly secured to the rope 2 to be swung about the top loop portion 20 held on the upper brackets 6 to serve as a swing when the player sits on the seat 1. The bar 5 horizontally secured to the two rope strings as shown in FIG. 1 will serve as a high bar so that a player can hold the bar 5 for swinging his or her body for playing or exercise purpose.

The longitudinal plate 3 includes: two elongate extensions 31 parallelly transversely formed on a bottom surface of the plate 3 disposed on a rear and a front side of a latitudinal axis 30 transversely existing in a central portion of the plate 3 to be engageable with the two elongate grooves 11 formed in the seat 1. By engaging the two extensions 31 of the plate 3 with the two grooves 11 of seat 1 as shown in FIG. 2, the plate 3 is hanged on the rope 2 to serve as a seesaw as shown in FIG. 2. The players can hold the straps 23 which can be tied to form a knot 231 for safety purpose.

Figure 5:
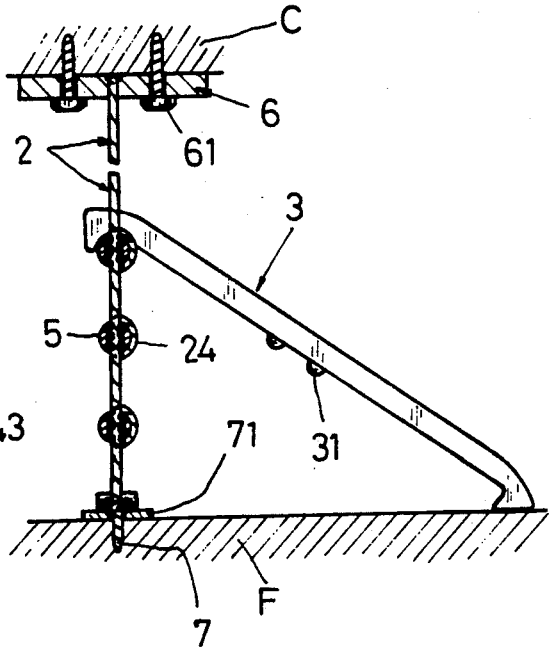
FIG. 5 shows another slide made by the present invention.

The longitudinal plate 3 further includes: two side rails 32 longitudinally formed on a right side and a left side of the plate 3 serving as a hand rest or rail when used as a slide as shown in FIG. 4, two angle blocks 33 respectively formed on a rear and a front end portion of the plate 3, and two slits 34 vertically formed through the two side rails 32 as shown in FIG. 4. As shown in FIG. 4, the top loop portion 20 of the rope 2 is mounted on the two upper brackets 6 to be fixed on a top frame (not shown) to form an inclined "ladder" by fixing a lower portion of each rope string 21 on a lower buckle 71 fixed on a bottom wall W or floor F by nails 7. A plurality of bars 5 are transversely tied on the two rope strings 21 to form a "ladder". The upper bar 5 will also serve as a support for limiting the plate 3 for preventing its dropping. The lower angle block 33 as shown in FIGS. 4, 5 will lay on the floor F for stabilizing the plate thereby serving as a slide. Each rope string 21 is inserted into each slit 34 formed in each side rail 32. Other fastening means (not shown) can be further provided for firmly securing the plate 3 on the rope 2 for safety purpose. In FIG. 5, the rope 2 is vertically suspended to form a vertical ladder by fixing the top loop portion 20 on a ceiling C to form a "right-angle triangle" slide.

Figure 3:
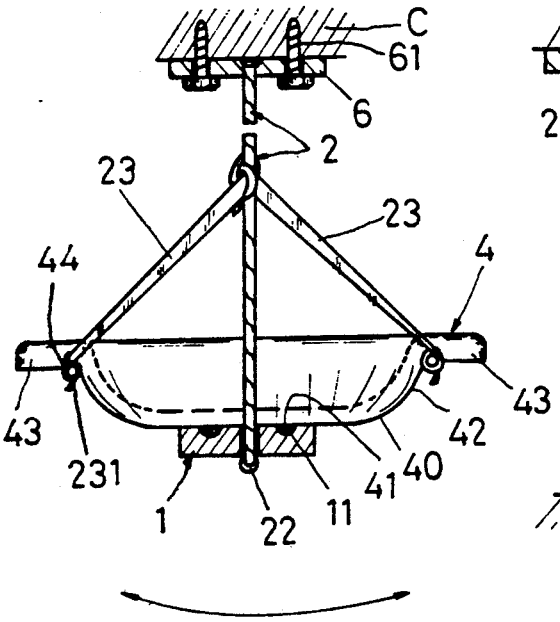
FIG. 3 shows a cradle made in accordance with the present invention.

The basin 4 as shown in FIG. 1, 3 includes a flat bottom portion 40 having two elongate extensions 41 parallelly formed on the bottom surface of the basin 4 disposed on a front and a rear side of a latitudinal axis 40 formed in the central portion of the basin to be engageable with the two grooves 11 formed in the seat 1, and a sloping surface 42 tapered downwardly inwardly from two side flanges 43 respectively formed on a rear and a front side of the basin. Each side flange 43 is formed an arcuate groove 44 in a bottom portion of the flange 43 to be hanged by the two straps 23 tied together at numeral 231 as shown in FIG. 3 to serve as a baby cradle.

The materials for the seat 1, plate 3, basin 4 and bar 5 can be made of plastic materials or other suitable materials.

The present invention is superior to a conventional playing equipment installed in a playground with the following advantages:

1. By selectively engaging a plate 3, or a basin 4 on the seat 1, a seesaw, a slide or a cradle may be immediately formed for convenient multiple uses at low cost and with tiny space.

2. Even removing the plate 3, or the basin 4 from the seat 1, the seat 1 hanged on the rope 2 may still serve as a swing. From this invention, a very interesting playing equipment may be optionally assembled by the player or players to form any desired device.

3. A single bar 5 may be tied on the rope to form a high bar for exercise purpose, whereas a plurality of bars 5 may be tied on the rope 2 to form a ladder for climbing purpose.

4. Such a playing set can be made of light, corrosion-resistant materials suitable for its installation in a house or interior place. The set can be fixed inside a house for D-I-Y (do-it-yourself) purpose without requiring any professional skill. So, a playing equipment of the present invention can be easily built for entertaining purpose in an interior location without worrying about the weather.

I claim:

1. A playing set comprising:

a basic seat hanged on a rope which is mounted on an upper frame, having at least a groove formed in said seat;

a longitudinal plate having at least a first extension formed on a central bottom portion of said plate, said first extension detachably engageable with said groove in said seat, said longitudinal plate operatively biased about a central portion of said seat secured with said rope;

a basin having at least a second extension formed on a central bottom portion of said basin, said second extension detachably engageable with said groove of said seat; and at least a bar horizontally transversely tied on said rope.

2. A playing set according to claim 1, wherein said basic seat includes two elongate grooves parallelly formed in said seat disposed on a rear and a front side of a longitudinal axis longitudinally formed in a central portion of said seat, and two rope holes respectively formed in a right and a left side of said seat generally perpendicular to said longitudinal axis of said basic seat for inserting two rope strings of said rope for securing and hanging said seat on said rope having at least a knot of said rope tied under said seat for retaining said seat on said rope.

3. A playing set according to claim 1, wherein said rope includes two rope strings protruding downwardly from two opposite side portions of a top loop portion of said rope, said top loop portion held in at least an upper bracket mounted on a ceiling by fixing elements selected from nail, screws and bolts.

4. A playing set according to claim 1, wherein said longitudinal plate includes two side rails respectively formed on a right and a left side portion of said plate, two angle blocks formed on a front and a rear end portion of said plate, and two slits respectively formed in two said side rails to be operatively inserted with a rope string in said slit for fixing said plate on said rope for serving as a slide.

5. A playing set according to claim 4, wherein said rope has its lower end portion secured to a lower buckle fixed on a floor and has an upper portion of said rope fixed on a ceiling, said rope having a plurality of bars transversely tied on said rope for serving as a ladder of a slide.

6. A playing set according to claim 1, wherein a plurality of straps are tied on said rope to be held by a player.

7. A playing set according to claim 1, wherein said longitudinal plate includes two first elongate extensions parallelly formed on a bottom portion of said plate disposed on a front and a rear side of a first latitudinal axis transversely formed in a central portion of said plate to be engageable with two elongate grooves formed in said basic seat.

8. A playing set according to claim 1, wherein said basin includes two second elongate extensions parallelly formed on a bottom portion of said basin disposed on a front and a rear side of a second latitudinal axis formed in a central portion of said basin to be engageable with two elongate grooves formed in said seat, a pair of sloping surfaces respectively tapered downwardly inwardly from two side flanges formed on a front and a rear side of said basin, and two arcuate grooves each said arcuate groove formed on a bottom portion of each said side flange and hanged by two straps tied together under said basin.

* * * * *